US008881477B2

(12) United States Patent
Whitfield

(10) Patent No.: US 8,881,477 B2
(45) Date of Patent: Nov. 11, 2014

(54) CEILING FRAME SYSTEM

(75) Inventor: David Whitfield, Artarmon (AU)

(73) Assignee: Enlighten Australia Pty Ltd, Artarmon (AU)

( * ) Notice: Subject to any disclaimer, the term of this patent is extended or adjusted under 35 U.S.C. 154(b) by 0 days.

(21) Appl. No.: 13/393,407

(22) PCT Filed: Aug. 24, 2010

(86) PCT No.: PCT/AU2010/001089

§ 371 (c)(1),
(2), (4) Date: Apr. 30, 2012

(87) PCT Pub. No.: WO2011/022765

PCT Pub. Date: Mar. 3, 2011

(65) Prior Publication Data

US 2012/0204506 A1 Aug. 16, 2012

(30) Foreign Application Priority Data

Aug. 24, 2009 (AU) ..... 2009904006

(51) Int. Cl.

| | |
|---|---|
| ***E04C 2/52*** | (2006.01) |
| ***E04B 9/34*** | (2006.01) |
| ***E04B 9/06*** | (2006.01) |
| ***E04B 9/00*** | (2006.01) |

(52) U.S. Cl.

CPC ..... *E04B 9/006* (2013.01); *E04B 9/064* (2013.01)

USPC ..... 52/220.6; 52/506.07; 439/120

(58) Field of Classification Search

USPC ..... 52/220.6, 28, 220.4, 506.06, 506.07; 439/113, 120

See application file for complete search history.

(56) References Cited

U.S. PATENT DOCUMENTS

| | | | | |
|---|---|---|---|---|
| 3,719,818 | A * | 3/1973 | Porter et al. | 248/317 |
| 5,274,967 | A * | 1/1994 | Mladichek | 52/93.1 |
| 2003/0021116 | A1* | 1/2003 | Miller et al. | 362/249 |
| 2006/0272256 | A1* | 12/2006 | Frecska et al. | 52/506.07 |
| 2007/0123075 | A1* | 5/2007 | Insalaco et al. | 439/120 |
| 2009/0255203 | A1* | 10/2009 | Richardson et al. | 52/506.06 |
| 2010/0229475 | A1* | 9/2010 | Myers et al. | 52/173.1 |

* cited by examiner

*Primary Examiner* — William Gilbert
(74) *Attorney, Agent, or Firm* — Design IP

(57) ABSTRACT

A ceiling frame system 1 comprises a plurality of frame members 1 configured to depend from the ceiling. The frame members 1 include one or more service conduits 11 and are configured to be interconnected to one or more other frame members 1 to interconnect said service conduits 11 between predetermined interconnected frame members 1. The services are accessible at one or more predetermined locations along the length of each frame member 1. A ceiling frame member 1 is also provided.

13 Claims, 1 Drawing Sheet

CEILING FRAME SYSTEM

FIELD OF THE INVENTION

The present invention relates to the provision of ceilings in buildings and, in particular, to a ceiling frame system.

The invention has been developed primary for use in concrete commercial constructions and will be described hereinafter with reference to this application. However, it will be appreciated that the invention is not limited to this particular field of use.

BACKGROUND OF THE INVENTION

In commonly used conventional multi-storey concrete commercial constructions, a concrete ceiling is provided where that ceiling can be also the floor of a higher level. In the provision of an aesthetically appealing finished ceiling, a ceiling grid is typically used. The grid is formed from a square grid of frame members that are hung from the concrete ceiling. The frame members are hung in rows and the rows are periodically interconnected between the rows by substantially the same shaped frame members.

The frame members are supported at predetermined locations by clips or other engagement means such as threaded rods so that the frames are hung to form a grid being substantially parallel to the concrete ceiling. The frame members can be generally described as being upside down T-shaped in cross-section and are typically solid in cross-section and formed from metal. The leg of the T-shape extends substantially vertically when hung so that the feet extend in a plane substantially parallel to the concrete ceiling.

Once a framing grid has been hung from the underside of a concrete ceiling, the spaces intermediate the frame members are filled with tile elements that typically simply rest upon the upper-side of a foot of one or more frame members. The tile elements are square or rectangular where the frame members form a square or rectangular recesses or seats for the tiles. Services run along the concrete ceiling under the frame to terminals. Services such as lighting units and air conditioning ducts are mounted intermediate frame members in place of the tile elements to provide those services to the areas below.

In this way, lighting and air conditioning can be positioned in areas of the ceiling as desired by simply disposing the services on the frame in place of a tile element and supply between the ceiling frame and the concrete ceiling. It will be appreciated that other services such as fire detectors and emergency warning systems as well as other services are disposed in the tile elements or bolted to the frame members or concrete ceiling. For example, smoke detectors are typically disposed on a tile element and a hole is bored through the tile to receive at least part of the smoke detector which is mounted thereto and connected to a cable disposed in the ceiling cavity created between the grid of frame members and the concrete ceiling.

It will be appreciated that a significant amount of cabling, for example lighting looms, are disposed in the ceiling cavity above the frame and are simply laid in a straight line or other expedient path between an entry or supply point and the lighting units. This results in significant amounts of cabling just for lighting. Furthermore, data cabling which is now disposed in practically every commercial building in relatively large quantities typically runs in all sorts of directions in a ceiling. When any new cabling or services are required, cable is simply laid through the roof cavity by removing each tile along the path between the entry and termination of the data cabling. Generally, the positioning of the services intermediate the ceiling frame and the concrete ceiling is made in an ad-hoc manner with no coordination.

It is universally recognised that conventional ceiling grid systems encourage the disorganised laying and disposal of cabling and service positioning as sometimes this is determined by convenience or ease of service delivery. This is particularly the case after a commercial building has been refurbished or renovated one or more times which is typical in the life of a commercial building. It will be appreciated that the process of maintenance of existing services or the installation of new services often results in damage or breakage of the tiles which can be difficult to remove and are particularly time consuming to manipulate. Furthermore, it will be appreciated that an architect does not have much freedom to operate in designing ceiling and ceiling cavities in view of the nature of the framing grid and the way services are disposed and provided.

GENESIS OF THE INVENTION

The genesis of the invention is the desire to provide a ceiling cavity in a building which overcomes or substantially ameliorates one or more of the disadvantages of the prior art, or to provide a useful alternative.

SUMMARY OF THE INVENTION

According to a first aspect of the present invention there is provided a ceiling frame system comprising a plurality of frame members configured to depend from the ceiling, the frame members characterised in that one or more frame members include one or more service conduits and are configured to be interconnected to one or more other frame members to interconnect said service conduits between predetermined interconnected frame members, wherein the services are accessible at one or more predetermined locations along the length of each frame member.

According to a second aspect of the invention there is provided a ceiling frame member configured to depend from a ceiling and including one or more service conduits extending therealong, the ceiling frame member configured to be interconnected to one or more other frame members such that services passing through the frame members in the service conduits are accessible at one or more predetermined locations along the length of each interconnected frame member.

According to another aspect of the invention there is provided a ceiling frame member comprising a pair of longitudinally extending frame member elements each having a leg and a foot, the element legs being spaced apart by two or more cross-members disposed intermediate the legs such that the feet are oriented away from each other, the frame member configured to depend from a ceiling with the element legs oriented substantially upwardly and to receive a conduit service duct having one or more services such that the service duct is configured to provide access to the one or more services in the service duct from the feet side of the frame member at one or more predetermined locations therealong.

It can therefore be seen that there is advantageously provided a ceiling frame system and frame member that allows services including lighting, building management and control systems to be delivered through the frame members rather than have the services mounted on top of or intermediate the frame members or mounted through or to the tiles. The system and frame members also advantageously allow cabling and the like to be transported therein saving the need to lay cable for each service as that service can simply be interfaced via the frame member. Furthermore, additional services can be added relatively easily.

BRIEF DESCRIPTION OF THE DRAWINGS

Preferred embodiments of the invention will now be described, by way of example only, with reference to the accompanying drawings in which.

DETAILED DESCRIPTION

Figure 1:
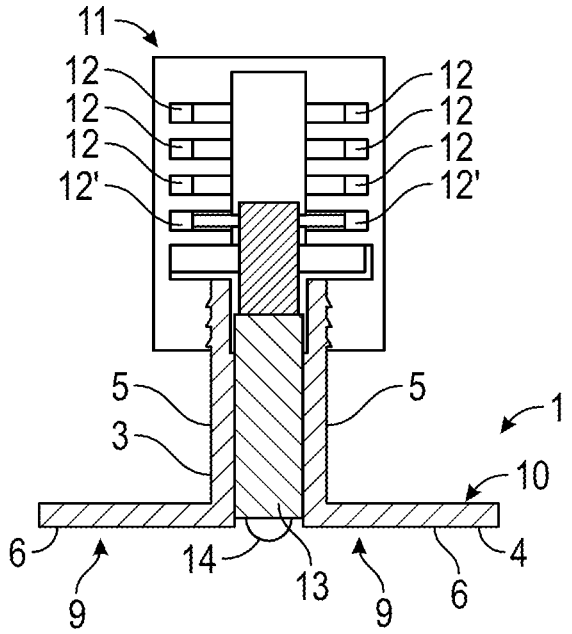
FIG. 1 is an end view of a frame member having a conduit service duct according to the preferred embodiment.
Figure 2:
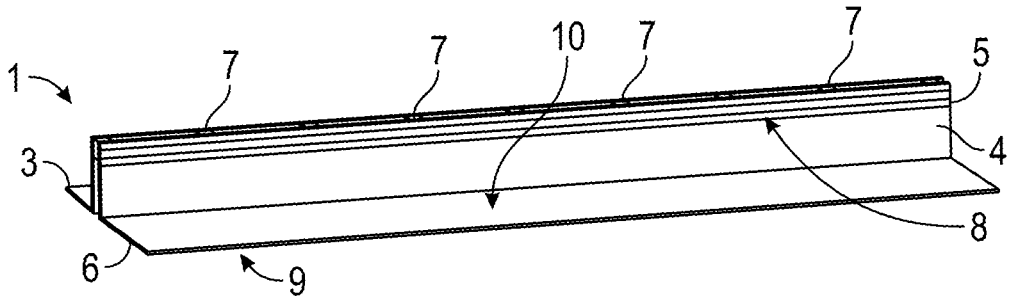
FIG. 2 is an elevated perspective view of the frame member of FIG. 1.
Figure 3:
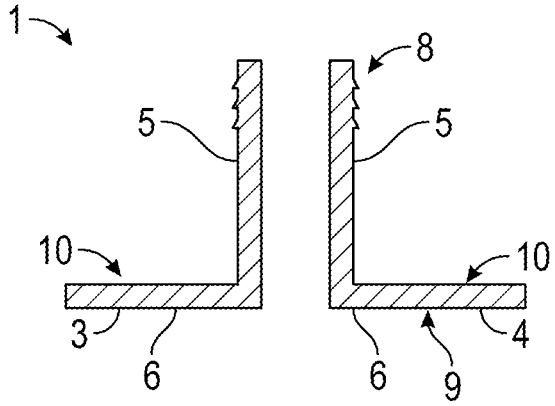
FIG. 3 is an end view of the frame member of FIG. 1.

Referring to FIGS. 1 to 3 of the drawings and in accordance with the first preferred embodiment, the frame member 1 includes a conduit service duct 11 having a preferred length. The ceiling frame member 1 of the first preferred embodiment has a pair of longitudinally extending frame member elements 3 & 4 each having a leg 5 and a foot 6. The frame member elements 3 & 4 are formed from extruded metal but can be formed from plastic or any other preferred material. The element legs 5 are spaced apart by a plurality of cross-members 7 disposed intermediate the legs 5. In this configuration, the feet 6 are oriented away from each other.

The frame member 1 is configured to depend from a concrete ceiling (not illustrated) with the element legs 5 oriented substantially upwardly toward the concrete ceiling. The legs 5 each include a barbed section 8 at one end distal from the feet 6. Clips (not illustrated) are secured to the concrete ceiling and extend down a predetermined length to releasibly engage with the leg barbs 8 about the legs 5.

Although not illustrated, the frame member 1 is configured to engage with another frame member at each end. The frame member 1 engages directly with the other frame member, however, it will be appreciated that clips or connectors can be disposed intermediate to connect the frame members 1. A grid of hung frame members 1 can then be formed to extend substantially parallel to a concrete ceiling. The grid can be square, rectangular, polygonal, curved or circular, or any preferred shape. A lower face 9 of each foot 6 then faces downwardly toward a room or other area (not illustrated).

That is, the frame members 1 can be interconnected longitudinally, transversely or at some angle to form a grid which may in itself include only a single frame member 1 of predetermined length in an area that is very narrow, for example. Further, interconnecting frame members, for example those extending transversely between frame members 1, need not be the same as frame member 1 and may not deliver services. Tile elements (not illustrated) are then disposed intermediate the frame members 1 and rest on an upper face 10 of each foot which faces the concrete ceiling.

The frame member 1 is configured to releasibly receive a conduit service duct 11 at one or more locations therealong. The conduit service duct 11 is preferably received intermediate two or more cross-members 7. The conduit service duct 11 includes an 8-channel electrical connector where each channel is denoted by reference numeral 12. However, any preferred number of channels can be provided as desired. The duct 11 shows two lower channels 12' that supply power to lighting on one circuit, while other circuits can provide power to other types of lighting, provide controls for emergency lighting and/or emergency warning intercommunications systems (EWIS) or provide access to building control systems.

Alternatively, the conduit service duct may not have cabling or electrical or optical services but may be configured to deliver air from air-conditioning services or alternatively allow return air for air-conditioning systems. It will be appreciated that services can connect or lock into the channels 12 though the use of locking teeth, for example, however, some services may be suspended from the ceiling grid, for example, a power supply or computer connector. The service duct 11 associated with each frame member is configured to connect to a service duct of an adjacent frame member 1 in such a manner that respect channels 12 are connected to respective frame members 1. As with the connection of the frame members, the ducts 11 connect directly or via a connector disposed intermediate.

An LED lighting bar 13 is disposed in electrical connection with the lower lighting channels 12' by insertion from the lower faces 9 of the frame member feet 6. In this way, it will be appreciated that other lighting elements (not illustrated) can be disposed along the frame member at predetermined locations to provide the desired level of lighting. It will be appreciated that the channels 12 in the duct 11 form other lighting circuits and can also be accessed in the same manner as lighting bar 13. Furthermore, the lighting bar can be received at one or more predetermined locations along a frame member 1 where separate connections to receive the LED light bar are provided or, alternatively, tracks connected to lighting channels 12 are exposed along all or part of the length of the frame member 1 so that the light bar 13 forms a contact regardless of where along the member 1 it is disposed. That is, a slot is open along the frame member 1 where lighting electrical contacts are disposed such that insertion of the lighting bar 13 creates an electrical connection and the lighting bar is retained by the frame member 1 or alternatively by engagement directly with a channel 12. In this way, the frame member 1 may be disposed above a plaster ceiling having suitable service access and, in the case of lighting bar 13 for example, lighting bar electrical contacts extend through the plaster (or other) ceiling and engage with frame member 1.

The LED lighting bar 13 includes a single LED element 14. It will be appreciated that the lighting bar 13 can be configured to form electrical connection with two or more of the lighting channels by means of keyed engagement or other conventional connection. In this way, the services channels 12 can be used to distribute different services that can only be connected by pre-configured elements.

Although not illustrated, it will be appreciated that the service channels 12 can provide other services that are accessible from the lower faces 9 of the frame member legs 5. These services can be accessed at predetermined locations along the frame member 1. The services running through service channels 12 in a predetermined area can be controlled by a controller (not illustrated) to allow delivery of the services as desired. For example, in controlling data flow along a duplexed data channel and receiving wall mounted user generated switching signals on lighting circuits. A master services controller configured to control an arrangement of predetermined areas each having a services controller can also be provided as desired.

It can be seen that the conduit service duct can include one or more services for delivery in addition to lighting. For example, the channels 12 can deliver telecommunications, data communications, data access points, air conditioning, emergency warning systems, fire alarms, and building management and control systems or indeed any other services as desired to provide access from the lower face 9 of the feet 6, or to mount smoke detectors, emergency warning equipment or other services. It will be appreciated that if desired services can be delivered from either side of the duct 11.

In the case of air conditioning, the duct 11 can be made to include an appropriately sized channel for air-flow which would be delivered from between the lower faces 9 of the feet 6. In such an embodiment, it will be appreciated that a delivery unit analogous to the lighting bar 13 can be provided to allow the directional delivery of the air.

In the preferred embodiment illustrated, it can be seen that LED lighting elements 14 can be disposed over those areas requiring lighting to some standard. If additional brighter areas are required, brighter LED lighting elements 14 can be used instead of or in addition to the other lighting elements 14. Not only can it be seen that the use of the frame member 1 allows the delivery of services therefrom removing the need for lighting and other services to be disposed intermediate the frame members 1, the duct 11 provides for all services to be able to be accessed via the lower faces 9 of the feet 6 avoid the need for time consuming maintenance and the possibility of tile breakage. A cover strip (not illustrated) can be disposed intermediate the feet 6. The cover can conceal access to the services from the lower faces 9 or provide a diffusing capability to lighting.

Use of the frame members 1 to deliver lighting services has the significant benefit of being easily able to respond to increasing or decreasing lighting requirements (or indeed any other services) but also typically allows significantly less power to be consumed to meet existing lighting requirement in commercial buildings. In many cases, the power savings by delivering lighting in accordance with the preferred embodiment can save a building owner the costly exercise of upgrading their mains power supply to accommodate additional tenants or having tenants increase their power consumption. It is believed perhaps 10%, 20% or even more energy used by a building may be saved with use of the frame members 1 to deliver the lighting services.

Although not illustrated in detail, it will be appreciated that the frame members 1 can be formed from a material having a square, rectangular, polygonal or circular section. The frame members 1 may be of unitary construction or may be formed from components as described with reference to FIGS. 1 to 3. Furthermore, it will be appreciated that the frame members 1 may also be in the form of interconnectable tiles hung from or glued to concrete ceiling where each tile includes one or more service conduits disposed therein or mounted thereto. In this way, a ceiling can be formed from tile frame members 1 connected to adjacent tile frame members and where the one or more service conduits of adjacent tiles are interconnected.

The foregoing describes only one embodiment of the present invention and modifications, obvious to those skilled in the art, can be made thereto without departing from the scope of the present invention.

The term "comprising" (and its grammatical variations) as used herein is used in the inclusive sense of "including" or "having" and not in the exclusive sense of "consisting only of".

While the principles of the invention have been described above in connection with preferred embodiments, it is to be clearly understood that this description is made only by way of example and not as a limitation of the scope of the invention.

The invention claimed is:

1. A ceiling frame system comprising a plurality of frame members configured to depend from a ceiling, the frame members characterized in that one or more frame members include one or more service conduits and are configured to be interconnected to one or more other frame members to interconnect said service conduits between predetermined interconnected frame members, wherein each frame member includes a pair of longitudinally extending and parallel frame member elements each having a leg and a foot, the element legs being spaced apart by two or more cross-members disposed intermediate the legs such that the feet are oriented away from each other, the frame member configured to depend from a ceiling with the legs oriented substantially vertically and to receive over or intermediate said legs distal said feet a conduit service duct having one or more independently operable services such that the service duct is configured to allow access to the one or more services in the service duct intermediate the legs from the feet side of the frame member at one or more predetermined locations along the length of each frame member; wherein the system includes an auxiliary conduit services duct configured to releasable mount to the frame members, the auxiliary duct configured to include the one or more services such that the services are accessible from the frame members.

2. A ceiling frame system according to claim 1 wherein a plurality of interconnected frame members provide a grid defining a predetermined area such that each predetermined area includes a control box configured to control the flow of services through the grid of frame members.

3. A ceiling frame system according to claim 2 having a plurality of grids each having a respective services control box such that each control box is connected to a master services controller configured to control the flow of services to each grid area via each control box.

4. A ceiling frame system according to claim 3 wherein the plurality of grids provide a plurality of service conduits for the same or different services.

5. A ceiling frame system according to claim 1 wherein the service conduits are disposed within or mounted to the frame members distal said feet and the services include any one or more of lighting, telecommunications, data communications, data access points, air conditioning, emergency warning systems, fire alarms, and building management and control systems.

6. A ceiling frame system according to claim 5 wherein the lighting services includes one or more LED lighting devices disposed intermediate said frame member legs at predetermined locations on predetermined frame members.

7. A ceiling frame system according to claim 6 wherein the LED lighting devices are disposed in the frame members to provide areas of differential brightness.

8. A ceiling frame system according to claim 1 wherein the frame members are formed from a metal or plastic.

9. A ceiling frame system according to claim 1 wherein the frame members are formed from a pair of spaced apart elongate right angle sections retained together by clips.

10. A ceiling frame system according to claim 1 wherein the frame members include a plurality of discrete service conduits such that service conduits are interconnected to respective service conduits of an interconnected frame member, or one or more service conduits are terminated at an interconnected frame member.

11. A ceiling frame system according to claim 1 wherein the frame members and any service conduits interconnect to an end or a mid-section of an adjacent frame member, the interconnection being direct between members or via a connector adaptor disposed intermediate such that one or more service conduits of adjacent frame members are interconnected.

12. A ceiling frame system according to claim 1 further including ceiling tile elements disposed intermediate two or more interconnected frame members.

13. A ceiling frame system according to claim 1 including a frame member cover strip disposed along one side or face thereof.

* * * * *